US008444232B2

(12) United States Patent
Ceballos-Godefroy

(10) Patent No.: US 8,444,232 B2
(45) Date of Patent: May 21, 2013

(54) COLLAPSIBLE SHOWCASE

(76) Inventor: Ricardo Ceballos-Godefroy, México City (MX)

( * ) Notice: Subject to any disclaimer, the term of this patent is extended or adjusted under 35 U.S.C. 154(b) by 463 days.

(21) Appl. No.: 12/525,387

(22) PCT Filed: Dec. 12, 2007

(86) PCT No.: PCT/IB2007/004211

§ 371 (c)(1),
(2), (4) Date: Dec. 28, 2009

(87) PCT Pub. No.: WO2008/072088

PCT Pub. Date: Jun. 19, 2008

(65) Prior Publication Data

US 2010/0127604 A1 May 27, 2010

(30) Foreign Application Priority Data

Dec. 14, 2006 (MX) ..... PA/a/2006/014660

(51) Int. Cl.

| | |
|---|---|
| ***A47F 3/00*** | (2006.01) |
| ***A47F 5/08*** | (2006.01) |
| ***A47B 43/00*** | (2006.01) |
| ***A47B 47/00*** | (2006.01) |

(52) U.S. Cl.
USPC ..... 312/114; 211/149; 312/258

(58) Field of Classification Search
USPC ..... 312/117, 138.1, 258, 262, 140, 107, 312/108, 111, 281, 198, 242, 114; 211/149, 211/150, 201, 200, 186; 52/64, 69
See application file for complete search history.

(56) References Cited

U.S. PATENT DOCUMENTS

| | | | | | |
|---|---|---|---|---|---|
| 578,445 | A | * | 3/1897 | Cobleigh | 217/14 |
| 963,853 | A | * | 7/1910 | Benson | 312/258 |
| 1,393,224 | A | * | 10/1921 | Joy et al. | 312/198 |
| 2,445,164 | A | * | 7/1948 | Worthman | 160/127 |
| 3,434,769 | A | * | 3/1969 | Salet | 312/258 |
| 3,738,604 | A | | 6/1973 | Howlett et al. | |
| 3,817,396 | A | * | 6/1974 | Markson | 211/198 |
| 3,860,305 | A | * | 1/1975 | Bergman | 312/114 |
| 3,966,286 | A | | 6/1976 | Groseclose | |
| 4,057,308 | A | * | 11/1977 | Dunning, III | 312/262 |
| 4,147,198 | A | * | 4/1979 | Ytter | 160/135 |
| 4,569,564 | A | * | 2/1986 | Ahmann | 312/259 |

(Continued)

FOREIGN PATENT DOCUMENTS

| | | | |
|---|---|---|---|
| EP | 222130 | A2 * | 5/1987 |
| FR | 2707148 | A1 | 1/1995 |

(Continued)

*Primary Examiner* — Janet M Wilkens
*Assistant Examiner* — Andrew Roersma
(74) *Attorney, Agent, or Firm* — Browdy and Neimark, PLLC

(57) ABSTRACT

A collapsible showcase including a lower panel; an upper panel detachably mounted on the lower panel; a lower collapsible compartment attached to the lower panel and protruding outwards thereof; an upper collapsible compartment attached to the upper panel and protruding outwards thereof; wherein the lower an upper compartments are folded on the panel to which they are hingedly attached at least at one of their side walls. The showcase also has a collapsible base attached to the lower panel and protruding in a contrary direction from the compartments to provide stability to the showcase. The compartments may be divided in sub-compartments by dividers and the showcase may also include a shelf. When the showcase is folded, the collapsed compartments are located between both panels in a sandwich manner.

20 Claims, 18 Drawing Sheets

U.S. PATENT DOCUMENTS

| | | | | | |
|---|---|---|---|---|---|
| 4,579,401 | A | * | 4/1986 | Mears | 312/258 |
| 4,667,833 | A | * | 5/1987 | Jamison | 211/198 |
| 5,131,448 | A | * | 7/1992 | Miller | 160/135 |
| 5,211,405 | A | * | 5/1993 | Shelton et al. | 273/407 |
| 5,289,941 | A | * | 3/1994 | Blankenburg et al. | 220/552 |
| 5,450,967 | A | | 9/1995 | Mallory et al. | |
| 5,480,225 | A | * | 1/1996 | Bailey | 312/258 |
| 5,664,854 | A | * | 9/1997 | Letch | 312/262 |
| 5,775,034 | A | * | 7/1998 | Logue | 52/36.1 |
| 2003/0085640 | A1 | | 5/2003 | Chan | |
| 2005/0092705 | A1 | * | 5/2005 | Moss et al. | 211/132.1 |
| 2008/0053942 | A1 | | 3/2008 | Cox | |

FOREIGN PATENT DOCUMENTS

| | | | |
|---|---|---|---|
| GB | 1240109 | A | 7/1971 |
| MX | 01013307 | A | 6/2003 |
| WO | 2005013772 | A1 | 2/2005 |

* cited by examiner

COLLAPSIBLE SHOWCASE

FIELD OF THE INVENTION

The present invention relates to the techniques employed in the manufacture and design of furniture, displays and counters used in public locations known as "points of sale" wherein goods and services are offered to the public, and more particularly, it relates to a collapsible showcase.

BACKGROUND OF THE INVENTION

In different places where public converge for the acquisition and promotion of products and services such as exhibitions, conventions, information centers and so on, the use of furniture, displays and showcases is necessary so that people can make contact with suppliers and get to know their products. In this regard, a great variety of these pieces of furniture is available and built in wood, metal, with shelves and partitions; however, in general terms, they are bulky, difficult to handle and their transportation entails hardships as they occupy large footprints.

A known solution for this problems in the prior art, has been the creation of cardboard collapsible furniture and displays. Nevertheless, their poor structural rigidity is a drawback, as items of considerable weight cannot be placed thereon and, furthermore, it is impossible for the vendor to lean on such furniture.

One example of a cardboard showcase is described in the European Patent No. EP 0 575 275 A1, incorporated herein by reference. In addition, this type of cardboard furniture lacks a remarkable aesthetic appearance, which is an important factor in order to achieve a commercial impact for the product or service being offered.

In this sense, there are other types of furniture largely used in points of sales, such as displays and counters. Various collapsible versions of such furniture have been designed which are both practical and compact, such as the displays of the same inventor of the present invention and which are described in the Mexican Patents Nos. 212,227 and 225,710, as well as in the International Patent Application No. PCT/IB2005/002083. Moreover, in the Mexican Patent No. 233,812 belonging to the same inventor, a collapsible display module is described, comprised of racks or shelves, essentially partitioned in two halves, the upper part thereof folding over the first part to achieve the display module folded position; however, the display module of the Mexican Patent No. 233,812 lacks of transparent compartments as the display showcases require.

Moreover, both the cardboard displays or furniture and those mentioned in the previous paragraph are far beyond to satisfy the display showcase functions, wherein either for security purposes or to make the products more attractive, these are kept in transparent compartments with constrained access. As may be expected, the display showcase compartments should be made of materials such as glass, polycarbonate or transparent acrylic sheets.

Further, in display showcases, to allow observing the products contained in the compartments from different angles is preferred, as well as having an inner space acceptable to place therein different kind of items. Taking into account the above, having a low weight collapsible showcase with the compartments thereof having a large inner capacity would be desirable, but these have to be designed such that the folding of the showcase is permitted to allow it to be stored in a reduced space.

BRIEF DESCRIPTION OF THE INVENTION

In accordance to the above, the purpose is to eliminate the drawbacks of the showcases currently known by developing a collapsible showcase comprising a lower panel, an upper panel detachably joined over said lower panel, wherein both panels form the front of the collapsible showcase. Further, the collapsible showcase of the present invention comprises a lower collapsible compartment attached to the lower panel and protruding outwards therefrom; in a preferred manner, the lower compartment protrudes rearwards from the lower panel. There is also an upper collapsible compartment attached to the upper panel and protruding outwards therefrom; in a preferred manner, rearwards the upper panel. Both compartment inner parts are visible from different angles of the showcase.

The compartments do not have a stiff structure since they can be folded or collapsed over the panel to which they are attached; and for this purpose, both lower and upper collapsible compartments have a similar structure and each has the following parts:

i) a front wall built in the panel wherein the corresponding compartment is attached;

ii) a left side wall hingedly attached to the front panel;

iii) a right side wall hingedly attached to the front wall;

iv) a rear door hingedly attached to one of the side walls and housed inside thereof;

v) a top hingedly attached to one of the side walls and housed inside thereof; in addition, the top is detachably joined to the opposite side wall to which is hingedly attached, thereby allowing to provide structural stiffness to the compartment in its upper part; and, vi) a bottom hingedly attached to one of the side walls and housed inside thereof, the bottom is detachably joined to the opposite side wall to which it is hingedly attached, thereby allowing to provide structural stiffness to the compartment in its lower part.

The upper compartment is located immediately over the lower compartment in the present invention, and both are hingedly attached in at least one of the side walls thereof, thereby allowing to fold the showcase. Furthermore, it is also preferred that upper compartment bottom be at the same time the top of the lower compartment, that is, a common wall for both compartments is preferred.

In addition to the upper and lower panels, and lower and upper compartments, as another essential member the showcase comprises a collapsible base attached to the lower panel and protruding in a contrary direction from the compartments to provide stability to the showcase, since such base is in direct contact with the floor.

In order that the showcase be collapsed from its upright position, the top and bottom of each compartment are disassembled and moved apart to be housed within the side wall to which they are hingedly attached. Then, the rear door of each compartment is housed within the side wall to which it is hingedly attached; then, left and right walls are moved to be left on the panel where the respective panel is attached, and the side walls are placed one beside the other thereby finishing the folding of both compartments. Then, the upper panel is detached form the lower panel and rotates downwards supported in the hingedly attachment zone of the upper and lower compartments, such that at the end of this movement, both compartments already folded remain between both panels in a sandwiched manner. Finally, the base is folded to be placed over the lower panel thereby achieving the collapsed position for the showcase.

In a preferred embodiment of the invention, the lower or upper compartment includes at least one divider to form sub-compartments, which aid accommodating smaller items. These dividers are essentially a collapsible inner shelf hingedly attached to one of the side walls of the respective compartment. The shelf is housed in the wall wherein it is hingedly attached and it is detachably joined and to the opposite side wall, or even, the shelves may be provided at the front wall and be fixed to the rear door.

In addition to the above, in another embodiment of the invention, the showcase includes a collapsible shelf attached to the upper or lower panel and housed therein when the showcase is folded. In a preferred manner, the showcase extends rearwards thereof, the shelf is very useful for the salesmen since they may lean thereon to take notes, take purchase orders or to place computer equipment.

From the above, it can be mentioned that an object of the present invention is to provide a low weight collapsible showcase, being both resistant and having compartments with a great volumetric capacity.

Another object of the present invention is to provide a collapsible showcase wherein the compartments may be divided in sub-compartments in an easy and practical manner.

BRIEF DESCRIPTION OF THE DRAWINGS

The novel aspects deemed as unique to the present invention will be specifically set forth in the appended claims. Nevertheless, the invention—both in terms of its structure and manufacturing procedure thereof—together with other objects and advantages thereof, shall be better understood with the following detailed description of a preferred embodiment, when read in conjunction with the accompanying drawings, and wherein:

DETAILED DESCRIPTION OF THE INVENTION

Figure 1:
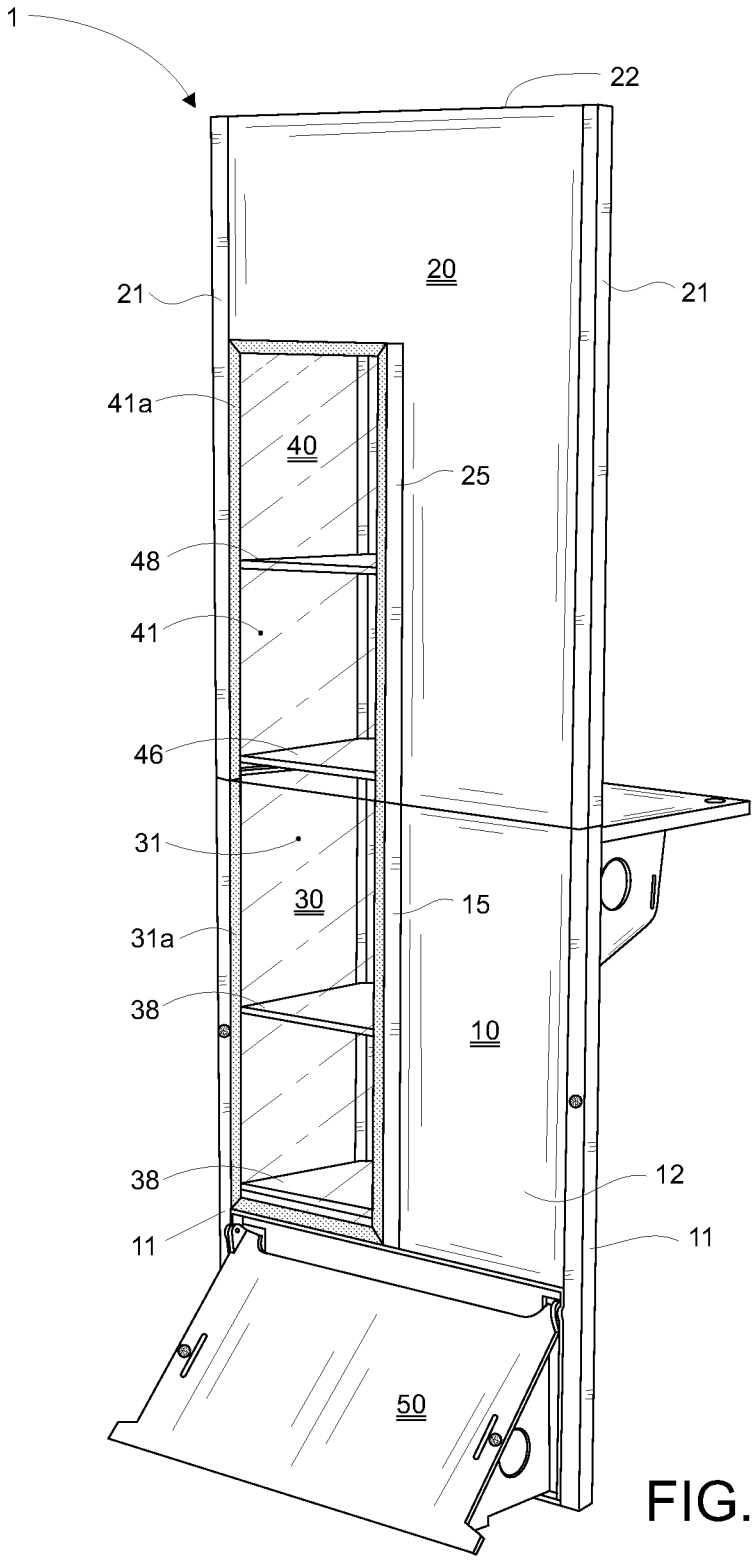
FIG. 1 is a left front perspective view of a collapsible showcase constructed in accordance with one preferred embodiment of the present invention, the showcase being in the upright position.
Figure 2:
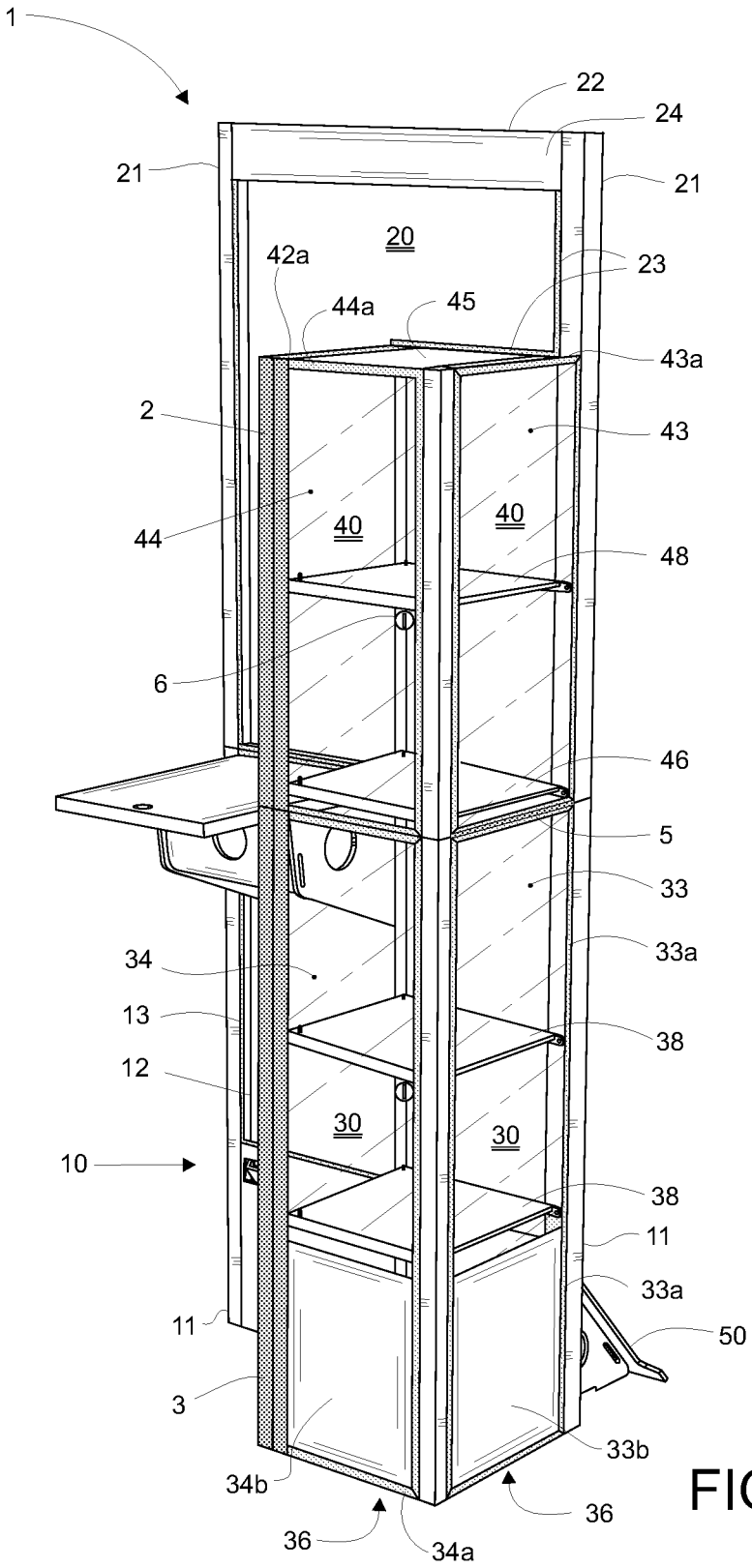
FIG. 2 is a right back perspective view of the collapsible showcase shown in FIG. 1.
Figures 3, 3A:
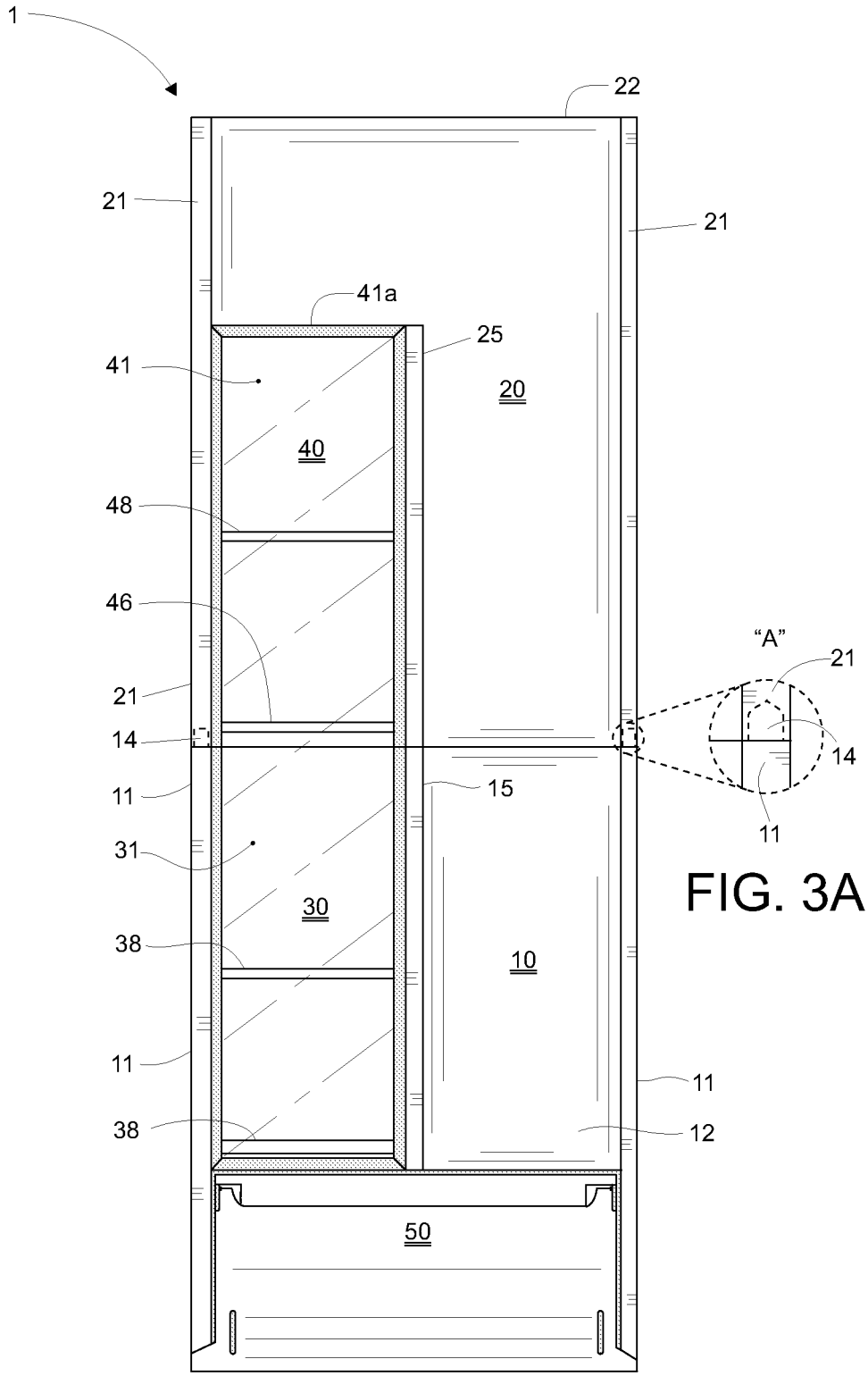
FIG. 3 is a front view of the collapsible showcase of FIG. 1.
FIG. 3A is an enlarged view of the side mounting zone between the upper panel and the lower panel in the collapsible showcase of FIG. 3.

By reference to the accompanying drawings, more specifically, to FIGS. 1 to 4 thereof, they show a collapsible showcase 1, which is constructed according to one preferred embodiment of the present invention, which is to be considered as illustrative rather than limitative to the present invention. In the present detailed description, the left, right, front and back orientations of the collapsible showcase are those perceived by a user thereof if he/she would stand behind the showcase meeting with a customer.

In the collapsible showcase of this first preferred embodiment, there is a lower panel referred to with the reference number 10, formed by a pair of side posts 11 and a plate 12 being bonded between both side posts 11. In the embodiment being described, the plate 12 is not fully flat and comprises a rim bending 13 protruding rearwards the showcase, this rim bending 13 allows having an extended surface at the plate flanks 12 to be firmly attached between the side posts 11, the rim bending 13 may be mainly seen from the rear side of the showcase 1. The lower panel 10 may also be formed by a frame, having any shape, and a plate attached thereon, but more material may be needed to make it.

Likewise, there is an upper panel 20 which is detachably joined on the lower panel 10. The upper panel 20 is essentially formed by a pair of side posts 21 and a plate 22 having a rim bending 23 for the plate to be attached between said side posts 21. The rim bending 23 includes a rib 24 at the upper and rear part of the panel 20, the rib 24 is to give the showcase a better finish at its upper part.

Figure 4:
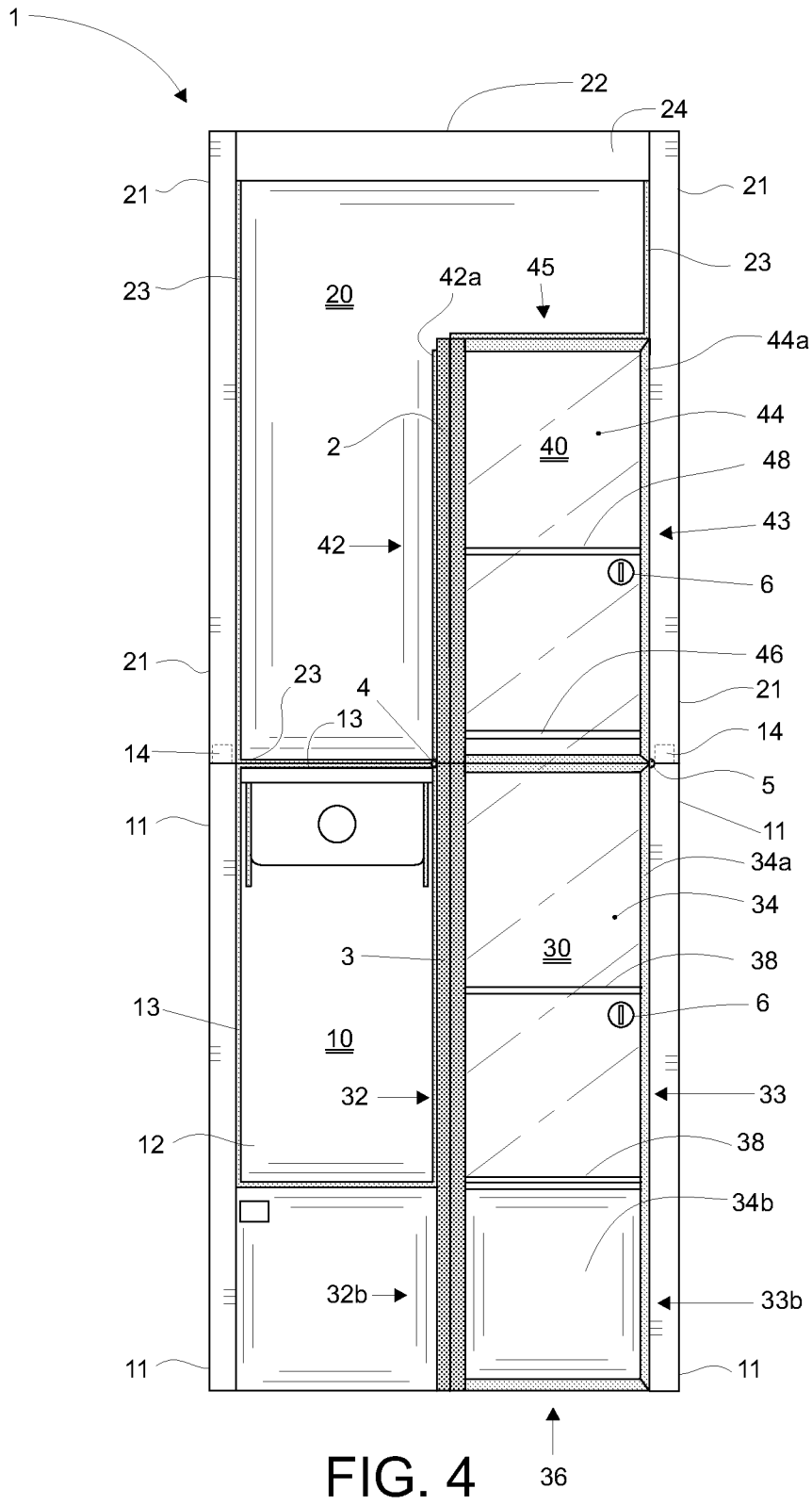
FIG. 4 is a back view of the collapsible showcase of FIG. 1.

It is important to note that both panels 10 and 20 are in contact by their rim bending 13 and 23, more specifically, the rim bending 23 of the upper panel 20 seats over the rim bending 13 of the lower panel 10 at the middle zone of the showcase, to provide stability to the upper panel and to avoid the pivoting thereof on the lower panel 10 (see FIG. 4).

The lower panel includes, at the upper end of each side post 11, a mounting protrusion 14, to be detachably joined to the upper panel 20 (see FIGS. 3, 3A and 4) inserting into one side post 21 of the upper panel 20. The mounting protrusions 14 are represented by dashed lines in FIGS. 3, 3A and 4, since they are hid inside the side posts 21 of the upper panel 20.

Lower and upper panels 10 and 20 form an extended and continuous surface at the front of the showcase 1 to place or to adhere graphic material such as labels or posters, to make the collapsible showcase 1 very attractive.

On the other hand, in FIGS. 1 to 4, it may be seen that there is an upper collapsible compartment 40 being attached to the upper panel 20 and protruding rearwards thereof. In a preferred manner, this upper compartment 40 is located at the middle right of the upper panel 20, but there are not restrictions for its location at other middle positions.

The upper collapsible compartment 40 has not a stiff structure since it may be folded or collapsed on the rear face of the upper panel 20. Specifically, the upper collapsible compartment 40 has a front wall 41 being built in the upper panel 20; for this purpose, the upper panel 20 has an embedded intermediate post 25 such that the front wall 41 is built in between said intermediate post 25 and the right side post 21.

The upper collapsible compartment 40 has also a left side wall 42 (marked in FIG. 4) being hingedly attached to the front wall 41; furthermore, there is a right side wall 43 hingedly attached as well to the front wall 41, and a rear door 44 hingedly attached to the left side wall 42 by means of the plastic hinge 2 running from the top to the bottom of the upper compartment 40, may be seen.

The rear door 44 is sized such that it may be housed within the left side wall 42 as the showcase is folded. However, there is no restriction in the present invention for the rear door 44 to be also hingedly attached to the right side wall 43 and to be housed therein.

The upper compartment 40 also includes a top 45 being hingedly attached to the left side wall 42 in such manner that it may be housed therein; in addition, the top 45 is attached to the right side door 43 but detachably, this means that both parts are not permanently joined but can be detached to fold the upper compartment 40. In this sense, the top 45 may also be hingedly attached to the right side wall 43 and detachably joined to the opposite side wall at the upright position of the showcase 1.

Finally, the upper compartment 40 has a bottom 46 hingedly attached to the right side wall 43 and housed therein, the bottom 46 is detachably joined to the left side wall 42 to provide structural stiffness to the upper compartment 40 at its lower part and also to fold it. The bottom 46 may be also hingedly attached to the left side wall 42 and be detachably fixed to the opposite side wall at the upright position of the showcase 1.

In the present invention, the upper compartment may be divided in sub-compartments. For this purpose, dividers are provided such as the inner collapsible shelf 48 that is hingedly attached to the right side wall 43 and housed therein. At the upright position of the showcase, the collapsible inner shelf 48 is detachably joined to the opposite side wall. There is neither a restriction for the inner shelf 48 to be attached to the left side wall 42 or even to be attached to the front wall 41. The upper compartment 40 has lower height than the upper panel height 20, but there is not a restriction to have the same height, so there is no limit to include more than one collapsible shelf and to form a plurality of sub-compartments, in a preferred manner, one collapsible inner shelf 48 is used and two sub-compartments are formed to half divide the upper compartment 40.

At the upper compartment 40, the front wall 41, rear door 44 and side walls 42 and 43 are transparent such that users passing around the collapsible showcase 1 may see to the inside of the upper compartment 40. Nevertheless, one of these walls being transparent is enough to show the inside of the compartment.

Each wall 41 to 43 and the door 44 are essentially formed by a frame respectively referred to as numeral references 41*a*, 42*a*, 43*a* and 44*a*, in turn, each frame 41*a*-44*a* includes a rim slot wherein a sheet of transparent material, preferably acrylic, is inserted. At this point, other transparent polymeric materials such as polycarbonate may also be used.

Once the upper compartment 40 has been described, it be readily understood the constitution of the lower compartment 30, since its structure is very similar to that of said upper compartment 40. Specifically, the lower compartment 30 has a front wall 31 being built in the lower wall 10 between an intermediate post 15 being embedded in said panel 10 and the side post 11 at the right side of the lower panel 10. The lower collapsible compartment 30 has the same height than the lower panel 10.

The lower collapsible compartment 30 further includes a left side wall 32 hingedly attached to the front wall 31; there is also a right side wall 33 hingedly attached to the front wall 31 and a rear door 34 closing the lower compartment 30, the door 34 is hingedly attached to the left side door 32 by means of a plastic hinge 3 running from the top to bottom of the lower compartment 30. The rear door 34 is sized such that is housed within the left side wall 32 in the collapsed position of the showcase 1. There is no restriction for the rear door 34 of the present invention to be also attached to the right side wall 33 and to be housed therein.

The lower compartment 30 has a bottom 36 hingedly attached to the left side wall 32 and housed therein, the bottom 36 is detachably joined to the right side wall 33 to provide structural stiffness to the compartment at the upright position of the showcase 1 but further allowing the folding of the lower compartment 30. The bottom 36 may also be hingedly attached to the right side wall 33 and may be detachably joined to the opposite side wall.

In the embodiment being described, the bottom 46 of the upper compartment 40 is at the same time the top of the lower compartment 30, that is, the compartments have a common wall. Further, the upper compartment 40 is located immediately above the lower compartment 30 and both are hingedly attached by plastic hinges 4 and 5, specifically the left side walls 32, 42 are joined by the hinge 4, and the right side walls 33 and 43 are joined by the hinge 5. These hinges 4 and 5 are of the outmost importance for the collapsible showcase since the upper panel 20 may be rotated thereon over the lower panel 10, to achieve the collapsed position of the showcase 1 as will be described hereinabove.

The lower compartment has at least one side wall, or front wall or rear door being transparent, moreover, it may be transparent at almost the entirety of its height, preferably at the upper two third parts, so the clients passing close to the showcase 1 may see the inside of the lower compartment 30; the lower third portion of the lower compartment 30 is not transparent, since it would be uncomfortable for the clients to lower to look at the lowest portion of the showcase 1. For this purpose, the front wall 31, side walls 32 and 33, as well as the rear door 34 are essentially made of a frame referred as 31*a*, 32*a*, 33*a*, and 34*a*, respectively. Each frame 31*a*-34*a* includes a rim slot wherein a sheet made of a transparent material, such as acrylic, is inserted, and more particularly, the side walls 32 and 33, and the rear door 34 as well, includes an additional non-transparent sheet below these transparent sheets, e.g., a PVC sheet being inserted at the respective frame and referred as 32*b*, 33*b* and 34*b* for the corresponding wall. The front wall 31 does not include a non-transparent sheet since it has a lower height than the side walls 32 and 33 and the rear door 34.

The lower compartment 30 may be divided into sub-compartments, being provided dividers for this purpose, such as the collapsible inner shelves 38 hingedly attached to the right side wall 33 and housed therein. In the upright position of the showcase 1, each collapsible inner shelf 38 is detachably joined to the opposite side wall to which it is hingedly attached. There is no restriction for each collapsible inner shelf 38 to be attached to the left side wall 32, or even that it may be attached to the front wall 31 and to be housed therein. In the embodiment being described, a pair of collapsible inner shelves 38 are included to form three sub-compartments, the lower sub-compartment not being transparent due to the PVC sheets 33*b*, 33*b* and 34*b*.

Compartments 30 and 40 include locking means to lock the doors 34 and 44 at the respective frame 34*a* and 44*a* and to restrict the respective compartment access, in the present embodiment, these means are provided as latches 6. In addition, other means as padlocks or pins may be used to restrict access inside the compartments 30 and 40.

In addition to the main members of the showcase 1, namely lower and upper panels 10 and 20, lower and upper collapsible compartments 30 and 40, the showcase 1 further comprises a collapsible base 50 attached to the lower panel and protruding in an opposite direction from compartments 30 and 40. This base is useful to provide stability to the showcase 1 since it contacts the floor. The constitution of the collapsible base 50 will be explained below.

Figure 5A:
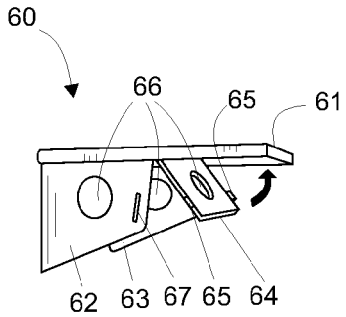
FIGS. 5A and 5B are left back perspective views of a shelf included in the collapsible showcase of FIG. 5 and illustrating the movement sequence to fold said shelf.
Figure 5B:
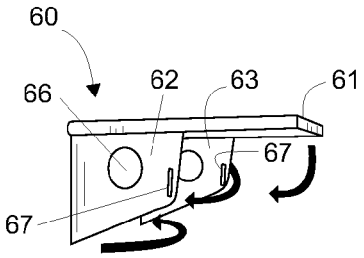
Figure 5:
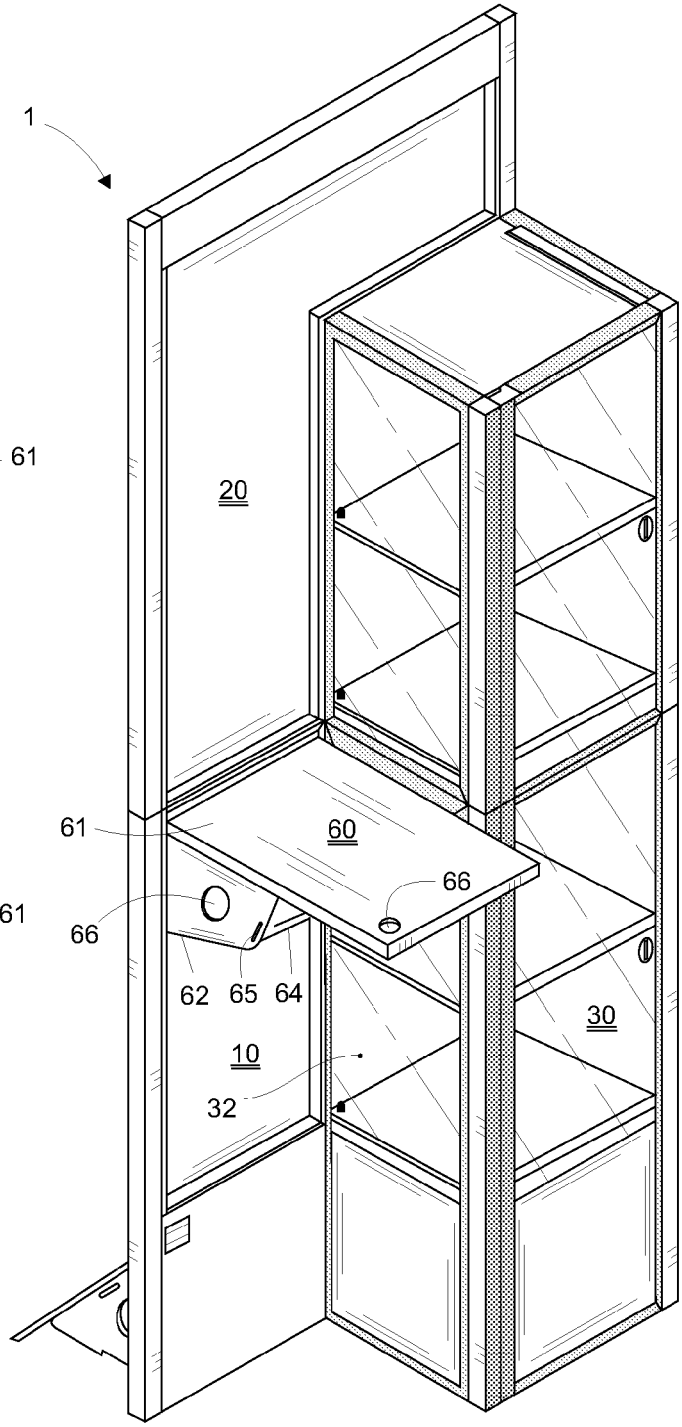
FIG. 5 is a left back perspective view of the collapsible showcase of FIG. 1.
Figure 6:
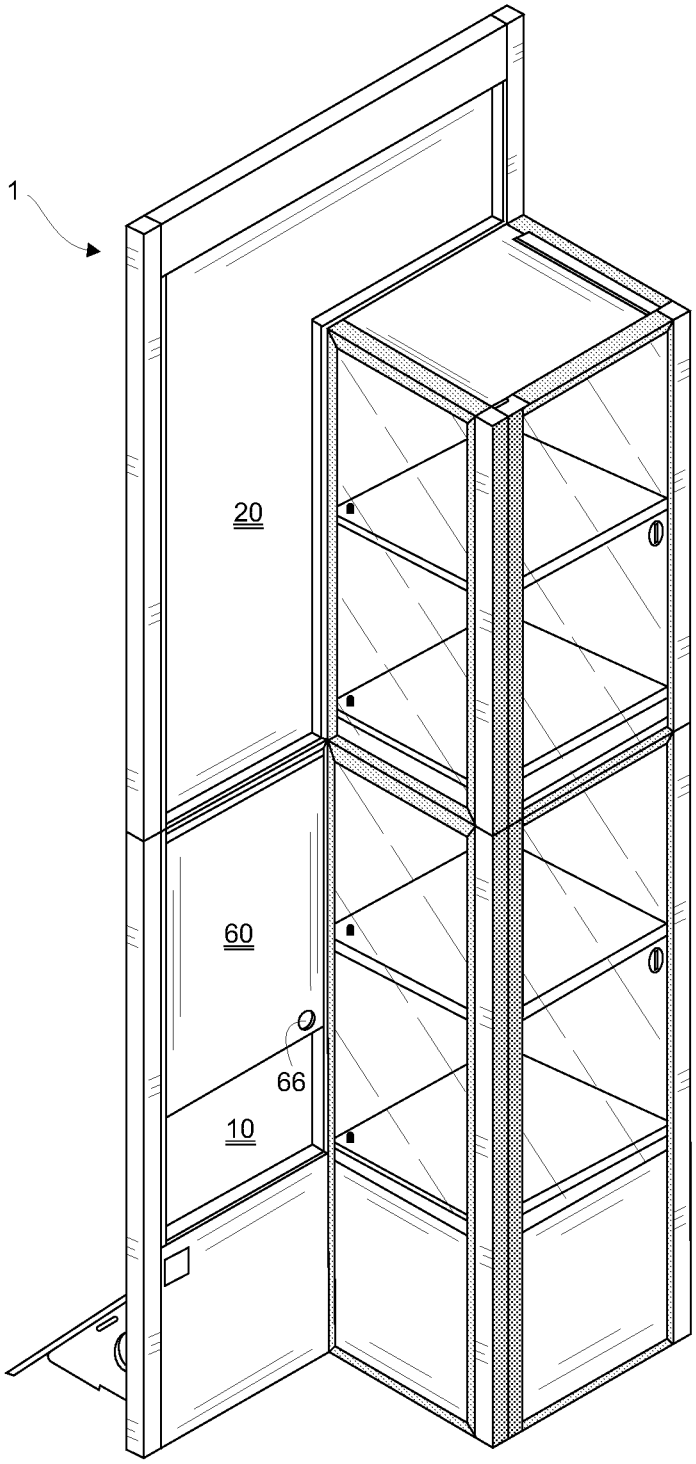
FIG. 6 is left back perspective view of a collapsible showcase of FIG. 6 with the shelf already folded.

Referring to FIGS. 5, 5A, 5B and 6, an optional member of the showcase 1 of the present invention will be described, which is incorporated in the embodiment being described, this optional member is the collapsible shelf 60. In FIGS. 5 and 6, as well as in subsequent figures, only those members allowing the understanding of the attachment and detachment of both essential and optional members of the showcase 1 are identified.

The shelf 60 is mounted on the rear face of the lower panel 10 extending rearwards thereof next to the left side wall 32 of housing 30. According to the present invention, there is no hindrance for the shelf 60 to be mounted on the upper panel 20 or even to mount additional shelves, provided that they are also collapsible. Shelf 60 is very helpful to salesmen to lean on and take notes, take client's purchase orders, or to place a laptop.

Shelf 60 is made of a cover 61 hingedly attached to the lower panel 10 in such manner that it may be housed therein. To support this cover 61, the shelf 60 includes a pair of side fins 62 and 63 contacting the lower face of the cover 61, both side fins 62 and 63 being also hingedly attached to the lower panel and may be housed in said panel 10 beneath the cover 61. Finally, the shelf 60 has a lower fin 64 hingedly attached to the lower face of the cover 61, the lower fin 64 has at its flanks a pair of tabs 65 to be respectively inserted in cooperating slots 67 provided at the side fins 62 and 63. The lower fin 64 increases the shelf 60 stability and stiffness. The cover 61, side fins 62 and 63, as well as the lower fin 64 have holes 66 through which the fingers can be introduced to pull each of these parts in order for both folding or building up the shelf 60, or also to introduce cables of an electronic equipment placed on the shelf 60.

In order to fold the shelf 60, the tabs 65 are removed from the side fins cooperating slots 67, then the lower fin 64 moves upwards to be housed within cover 61 (see FIG. 5A). Then, each side fin 62 and 63 moves in a direction towards each other to be housed within the lower panel 10, one above the other. Finally, as shown in FIG. 5B, the cover 61 with the lower fin 64 housed at its lower part, moves downwards to be housed within the lower panel 10 and pressing the side fins 62 and 63 to achieve the position as shown in FIG. 6, that is, with the shelve 60 folded.

Figure 7:
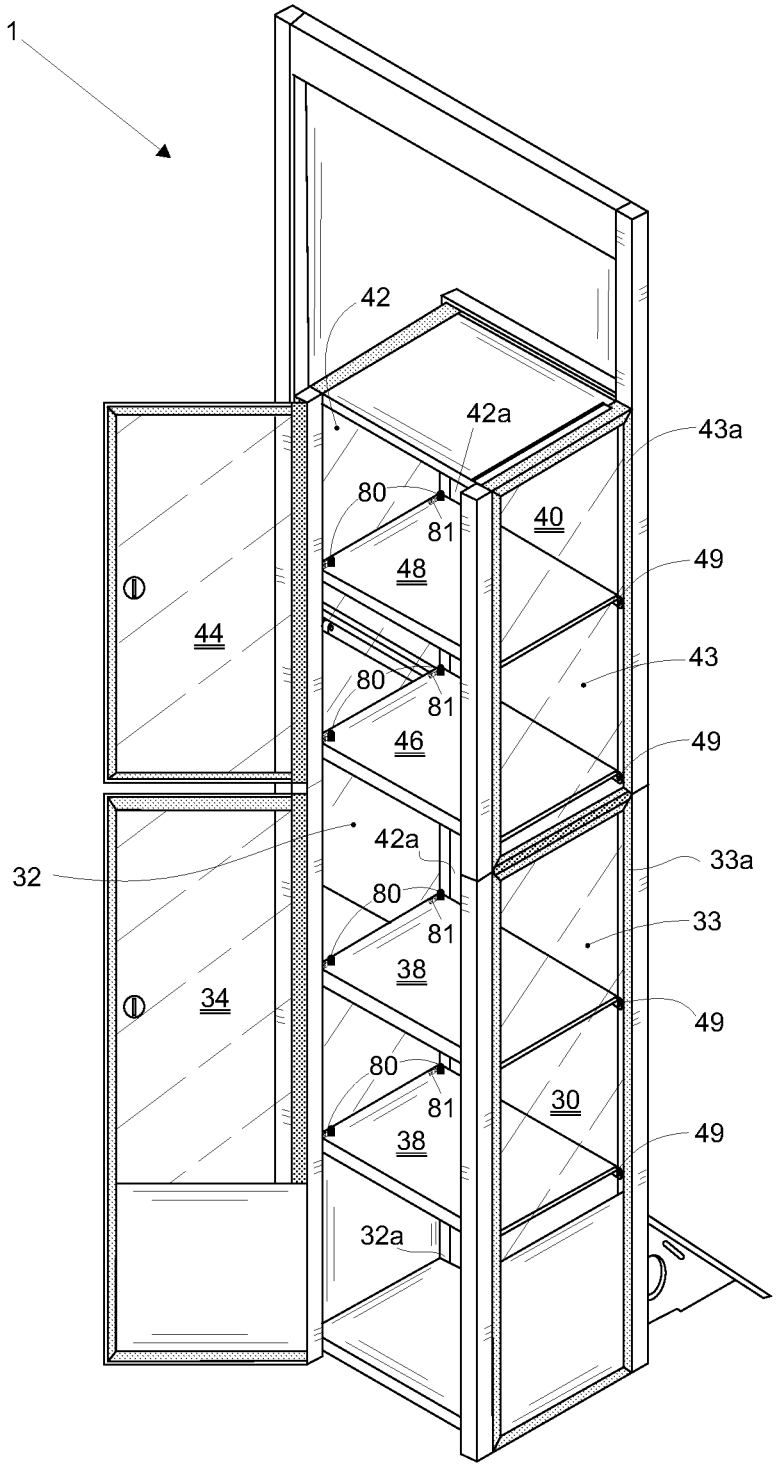
FIG. 7 is right back perspective view of the collapsible showcase of FIG. 6 with its doors opened.
Figure 8:
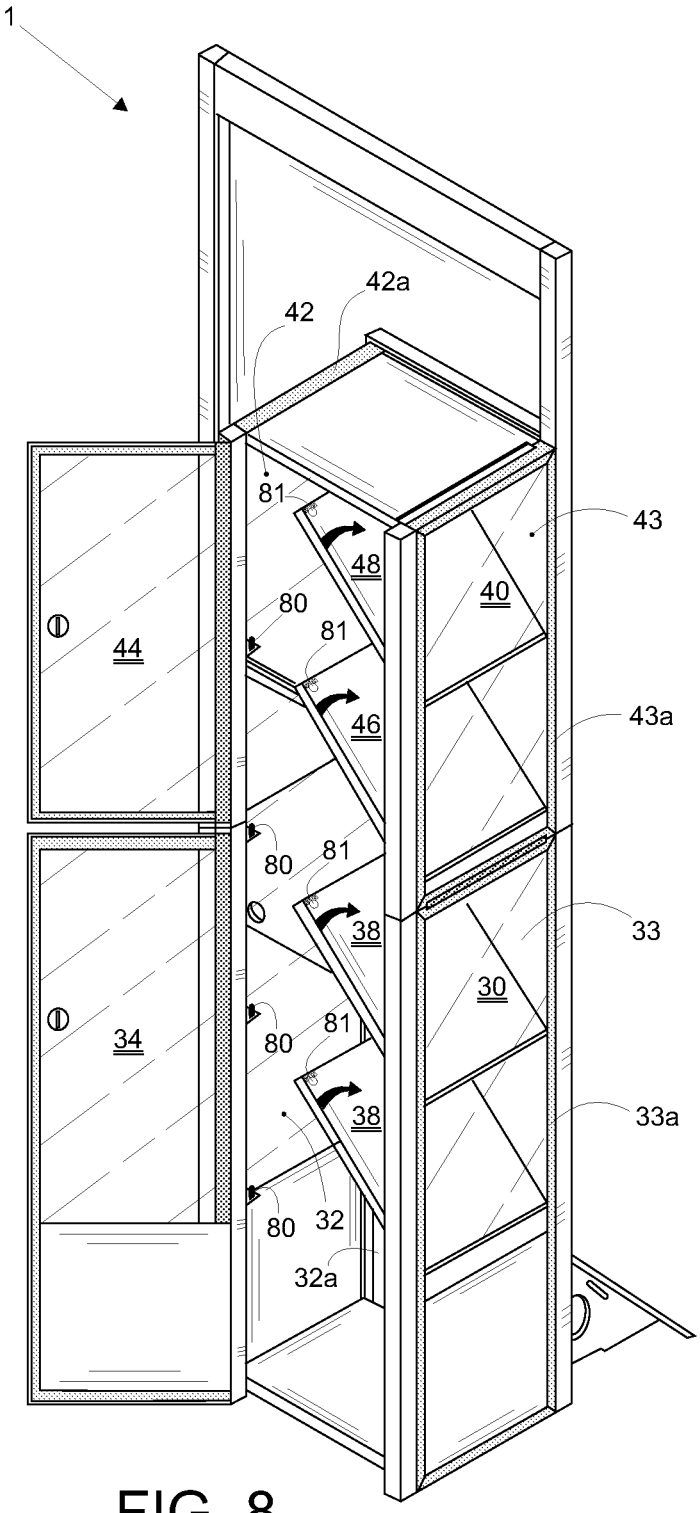
FIG. 8 is right back perspective view of the collapsible showcase of FIG. 7 with the collapsible inner shelves partially lifted.
Figure 8A:
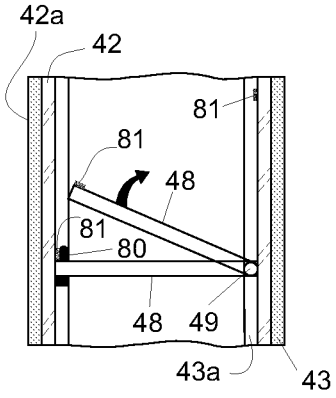
FIG. 8A is a side view representing the movement sequence to house one collapsible inner shelf in the wall to which it is attached.
Figure 9:
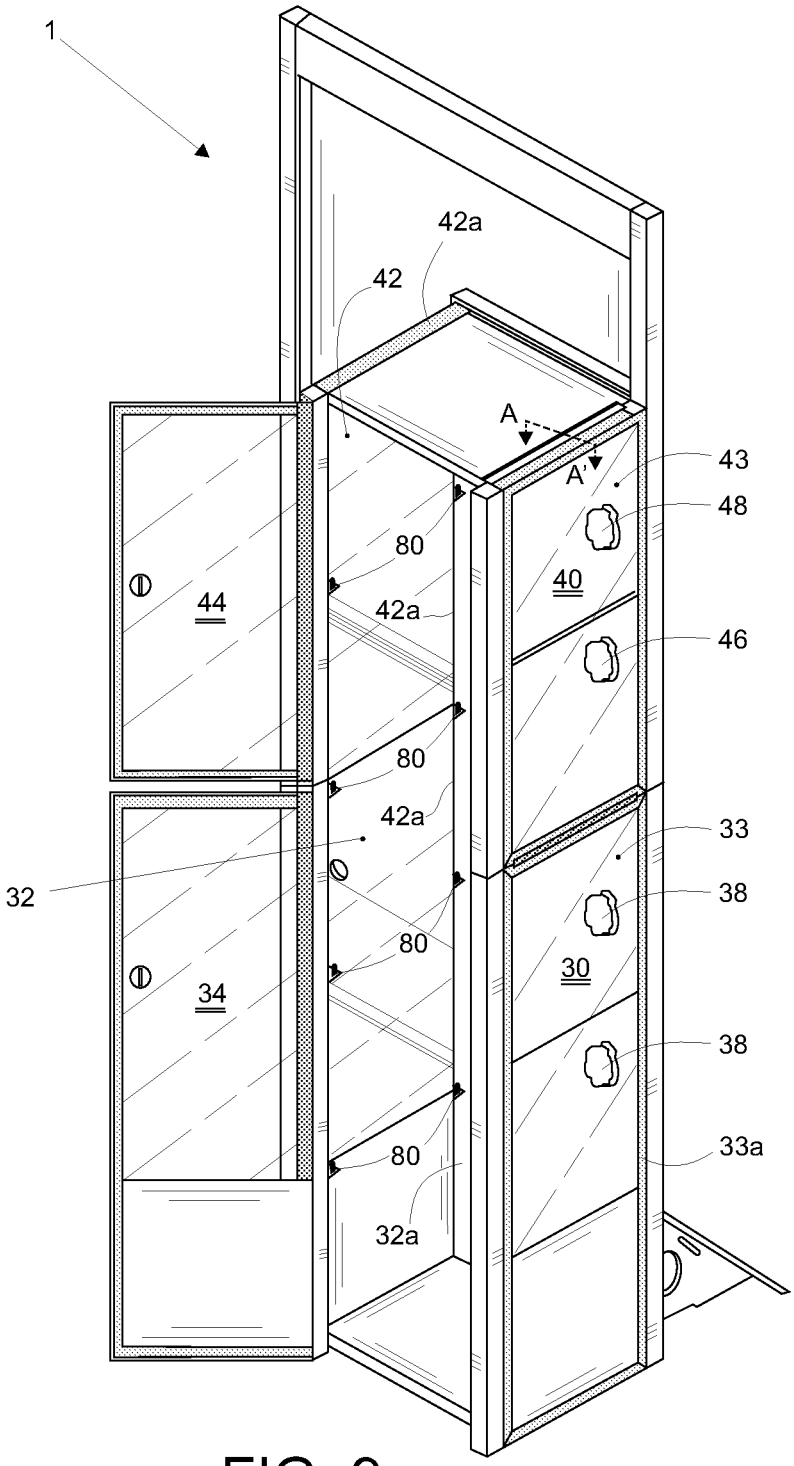
FIG. 9 is a right back perspective view of the collapsible showcase of FIG. 8 with the collapsible inner shelves already housed.

Now reference is made to FIGS. 7, 8, 8A and 9, to describe how the bottom 46 and the collapsible inner shelf 48 of the upper compartment 40, as well as the collapsible inner shelves 38 of the lower compartment 30 are folded. As mentioned above, in the present invention, the collapsible inner shelves 38 and 48 are optional, but they are illustrated in the present embodiment to appreciate versatility of the invented showcase. In FIGS. 7 to 9, the collapsible showcase is shown with open doors 34 and 44 to show the inside of both compartments 30 and 40.

Firstly, it is important to remember that, at the upper compartment 40, both the bottom 46 and the collapsible inner shelf 48 are hingedly attached to the right side wall 43. Likewise, at the lower compartment 30, the collapsible inner shelves 38 are hingedly attached to the corresponding right side wall 33. For said hingedly attachment, the bottom 46 as well as each collapsible inner shelves 38 and 48, include a pair of axles 49, provided at the right flank rear and front corners. The axles allow the bottom 46 and the collapsible inner shelves 38 and 48 to move from the top to the bottom either to be mounted or housed. Each axle 49 in turn is fixed either to the frame 33*a* or 43*a* of the right side wall 33 or 43 of the lower or upper compartment, respectively.

When the showcase is at the upright position, the bottom 46 and the collapsible inner shelves 38 and 48 are detachably joined to the respective compartment left side wall 32 and 42 by first fastening means, which in the embodiment being described, are the bases with pins 80 being attached inside the frame 42*a* of the left side wall 42 of the upper compartment 40. The same technical feature is provided at the collapsible inner shelves 38 of the lower compartment 30, with the only difference being that the bases with pins 80 are mounted on the frame 32*a* of the left side wall 32 of the lower compartment 30. Particularly, two bases with pins 80 are provided to the bottom 46 and for each collapsible inner shelf 38 and 48, each base with pin 80 is inserted at the left flank corners of the bottom 46 and the same occurs for the collapsible inner shelves 38 and 48.

The collapsible inner shelves 38 and 48 and the side wall to which they are hingedly attached are detached from the bases with pin 80 and moved upwards supported on their axles 49, to house the bottom 46. This movement is particularly represented in FIG. 8A for the collapsible inner shelf 48, however, it should be understood that the same is carried out for the bottom 46 of the upper compartment 40 and the collapsible inner shelves 38 of the lower compartment 30.

In the present invention, each collapsible inner shelf is housed in a vertical position to the side wall to which is attached and fixed in that position by first fastening means, which in the embodiment being described, are the hook and fiber (Velcro®) cooperative portions 81, clearly appreciated in FIG. 8A, said portions being adhered to the upper face of the collapsible inner shelf 48 and to the inner face of the right side wall 43, wherein the folding inner shelf 48 is hingedly attached, these hook and fiber (Velcro®) portions 81 or like means avoid having loose members hindering while the showcase is being built or folded. The same hook and fiber (Velcro®) portions 81 are provided for the bottom 46 of the upper compartment 40 and the collapsible inner shelves 38 of the lower compartment 30 and have the same function. The hook and fiber (Velcro®) portions 81 may also be provided at the lower face of each collapsible inner shelf 38 or 48.

Now reference will be made to FIGS. 10 and 11 to explain how the top 45 is housed within the left side wall 42 of the upper compartment 40, and also to explain how the bottom 36 is housed in the left side wall 32 of the lower compartment 30. Firstly, it has to be recalled that, at the upright position of the showcase 1, the top 45 is detachably joined to the right side wall 43, to this end, the top 45 includes a coupling portion 82, being essentially a plastic profile with a slot 83 wherein the frame 43*a* of the right side wall 43 (see FIG. 10A) is snap-fitted. To detach the top 45 from the right side wall 43, only the frame 43*a* is removed from the slot 83 thereby freeing the top 45 to be moved downwards by axles 49, allowing to be hingedly attached to the left side wall 42. These axles 84 are the same than axles 49 described above.

On the other hand, the bottom 36 of the lower compartment 30 is hingedly attached to the left side wall 32 by a pair of axles (not shown) being identical to the axles 49 and 84 described above. Moreover, the bottom 36 is detachably joined to the right side wall 33 by the bases with pin such as those in FIGS. 7 to 9 and referred as numeral reference 80. The bottom 36 is detached from its bases with pin by lifting it, and is housed within the left side wall 32 of the lower compartment 30. To keep it fixedly housed, cooperative hook and fiber (Velcro®) portions, such as those shown above in FIG. 8A, are provided.

Figure 11:
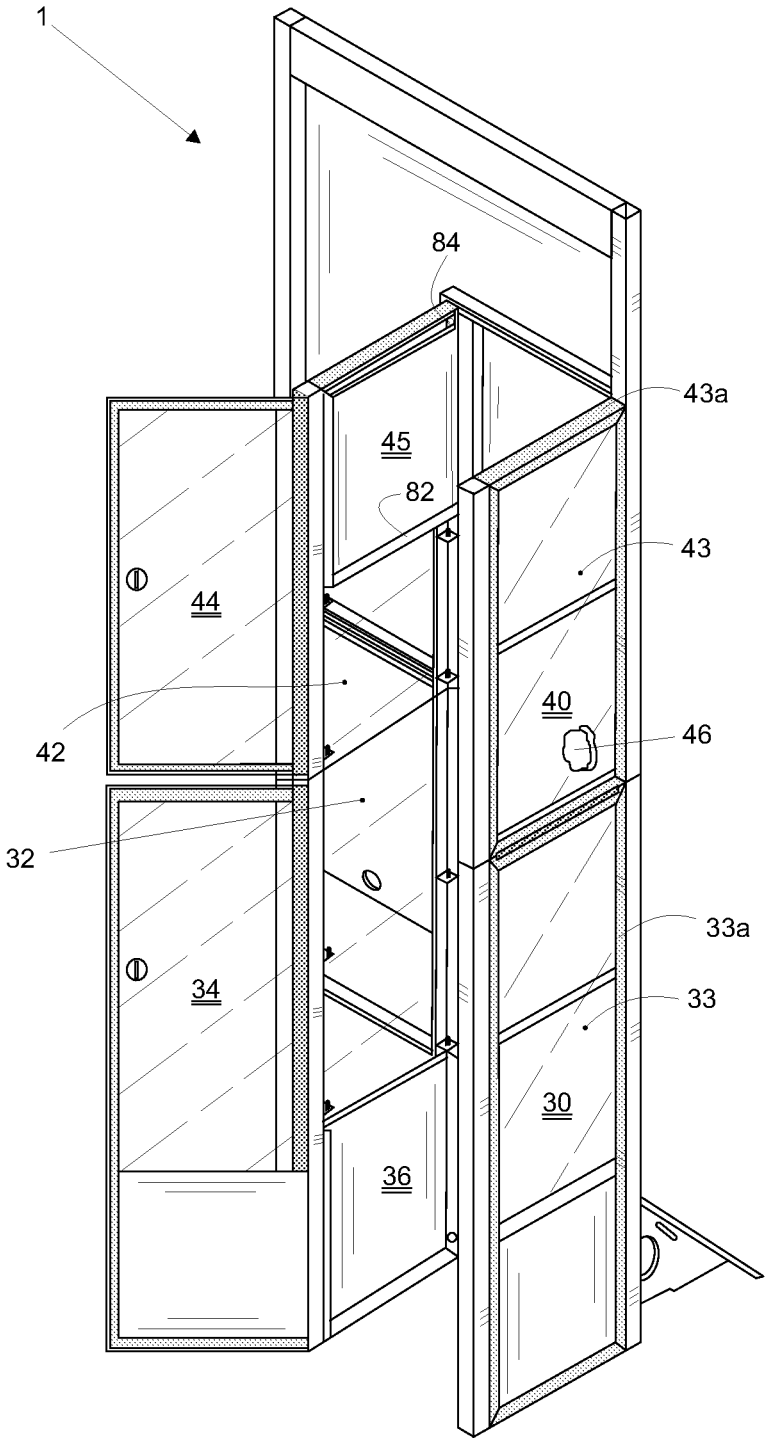
FIG. 11 is right back perspective view of the collapsible showcase in FIG. 10 with the upper compartment top and the lower compartment bottom already housed.

In FIG. 11, it is to be appreciated the manner in which the top 45 is housed in the left side wall 42, and it is also noted that the bottom 46 is housed in the right side wall 43. Moreover, the bottom 36 of the lower compartment 30 is housed in the left side wall 32 thereof. If the lower compartment 30 had its own top, it will also be housed in one side wall.

Figure 10:
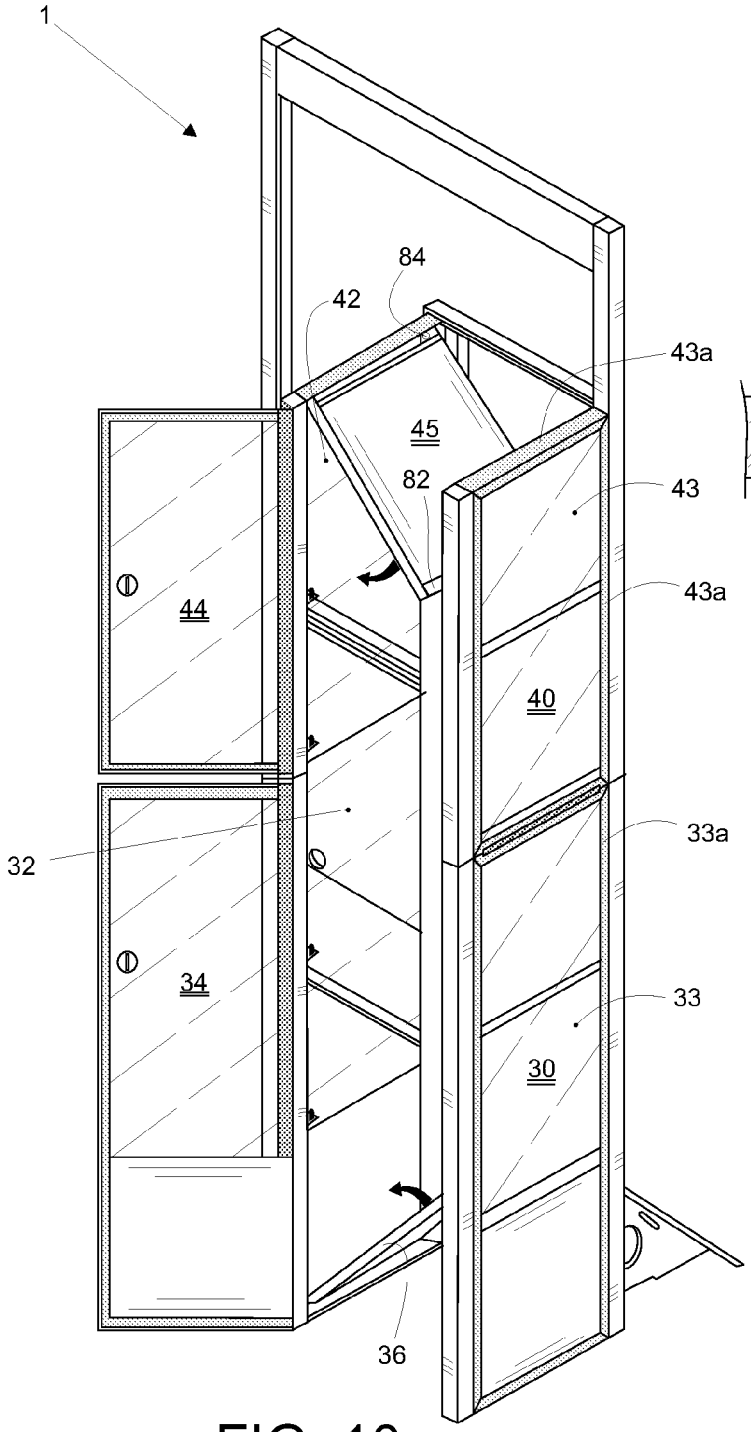
FIG. 10 is right perspective view of the collapsible showcase of FIG. 9 wherein the upper compartment top and the lower compartment bottom are housed.
Figure 10A:
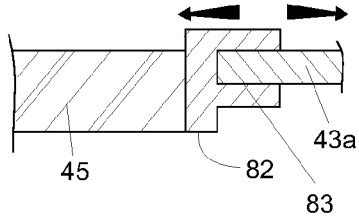
FIG. 10A is cross-sectional view through line A-A' in FIG. 9, wherein the assembly between the upper compartment top and the right side wall thereof is represented.

The open rear doors 34 and 44 are shown in FIGS. 10 and 11, to be housed within the side panel to which they are attached. In order to explain this movement, reference will be made to FIGS. 12 and 13, wherein, the door 34 of the lower compartment 30 moves on the hinge 3 and is housed in the left side wall 32, in a similar manner to the door 44 of the upper compartment 40 moves on the hinge 2 and introduces itself in the left side wall 42.

Figure 12:
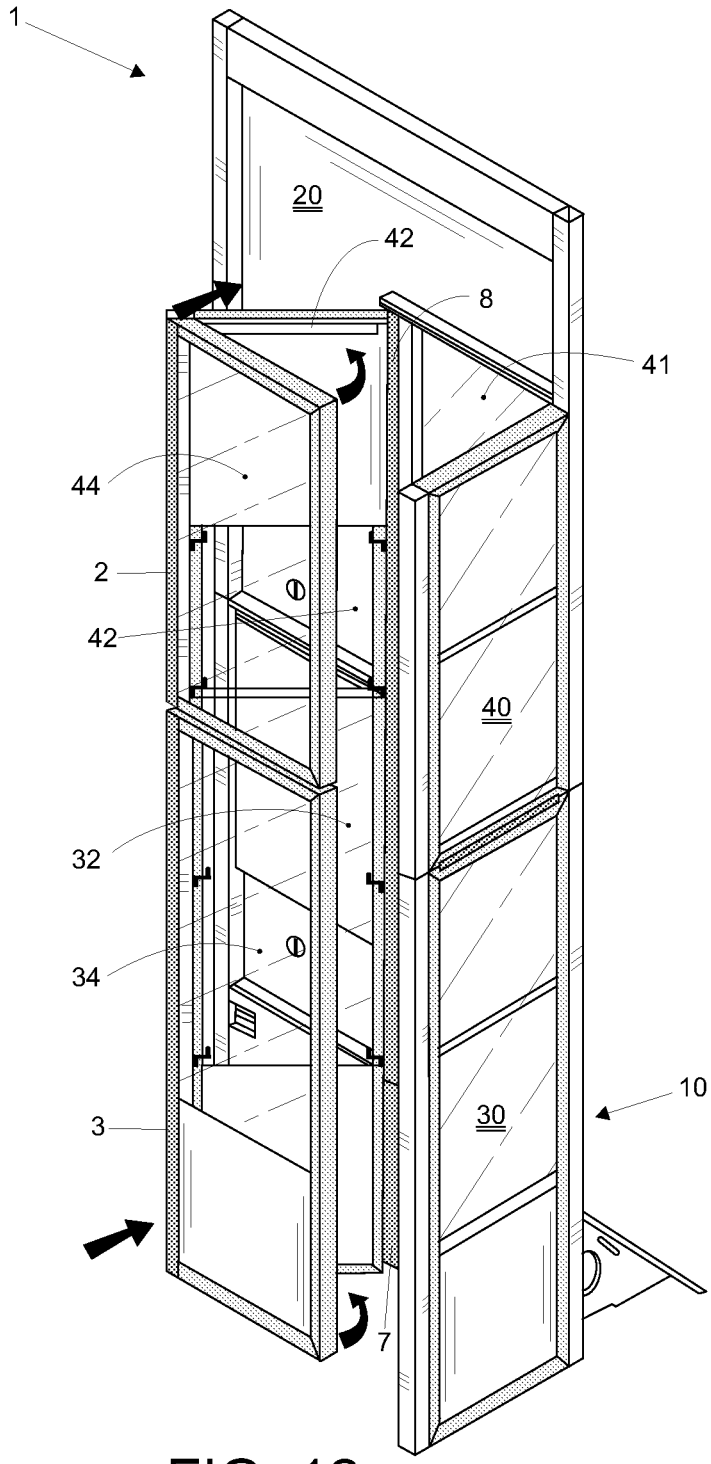
FIGS. 12 and 13 are right back perspective views of the collapsible showcase shown in FIG. 11, showing the movement sequence to fold the side walls of both collapsible showcase compartments.
Figure 14:
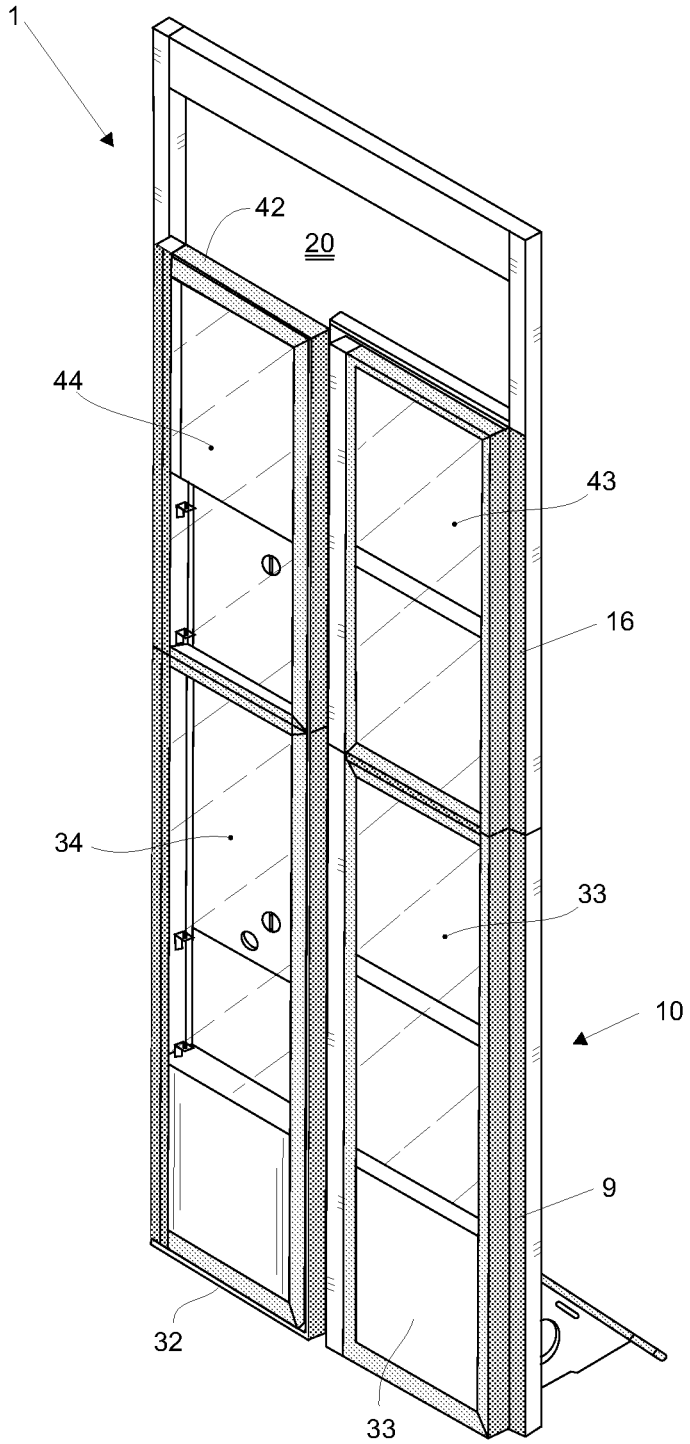
FIG. 14 is a view of the collapsible showcase of FIG. 13 with both compartments already folded.

Furthermore, FIGS. 12 and 14 shows that as the rear door 34 is housed in the left side wall 32, this moves on the hinge 7 at the lower panel direction 10, at the end of this movement, the left side wall 32 will be on the panel 10 wherein the lower compartment is provided, more particularly, at the left rear half thereof. It is helpful to note that hinge 7 hingedly attaches said left side wall 32 to the front wall 31 of the lower compartment 30. Hinge 7 allows having a wide movement for said left side wall 32.

The same movement is repeated in the upper compartment 40, that is, as the rear door 44 is housed in the left side wall 42, this moves on the hinge 8 and towards the direction of the upper panel 20, being located at the left rear half thereof. Hinge 8 hingedly attaches the left side wall 42 of the upper compartment to the front wall 41.

Figure 13:
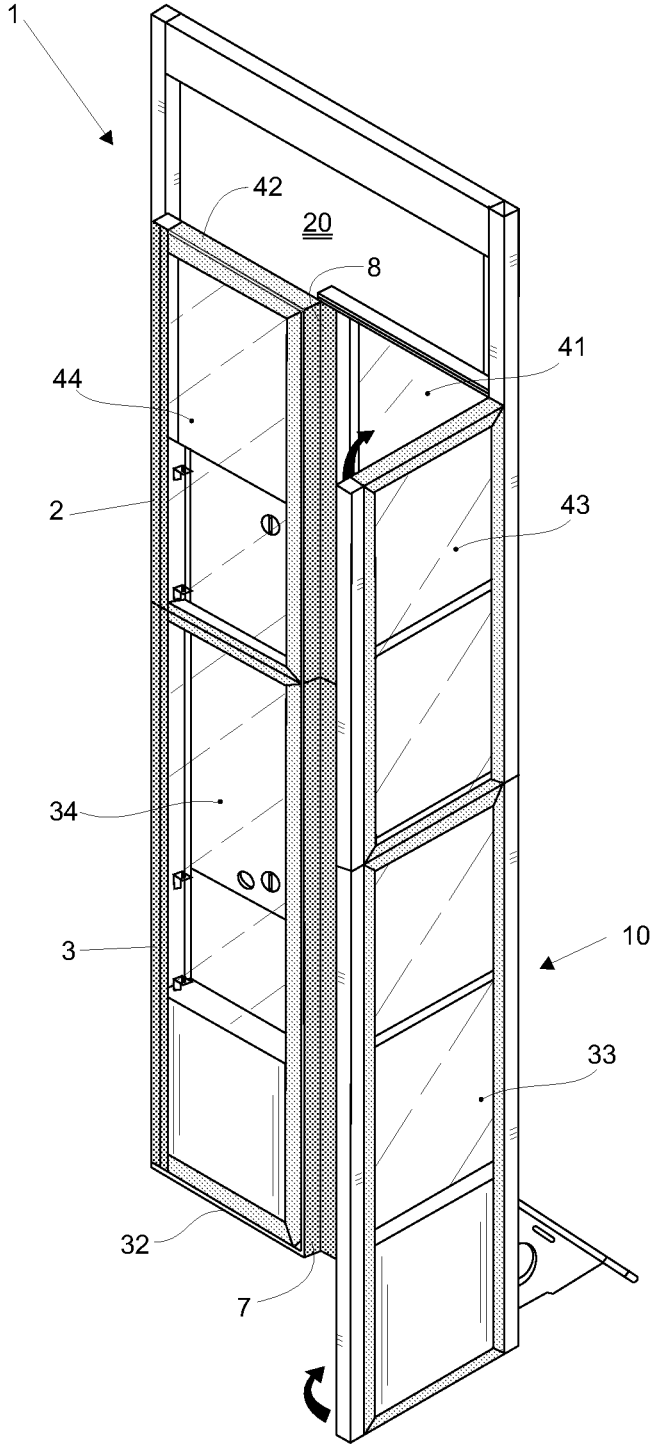

Now, reference will be made to FIGS. 13 and 14, to describe how the right walls 33 and 43 of both compartments are folded, to this end, the side wall 33 only moves on the hinge 9 toward the direction of the lower panel 10 being located at the right rear half, behind the lower compartment front wall and aside the left side wall previously housed and which already houses door 34. It is to be noted that hinge 9 is hingedly attached to the right side wall 33 with the front wall at the lower housing. In the same way, the right wall 43 of the upper compartment moves on the hinge 16 at the upper front wall direction 20 being located thereon, at the right rear half and behind the front wall 41. Of course, the right side wall 93 remains aside the left lateral all 42 previously housed and which in turn already houses the door 44; this movement ends the folding of both compartments for the showcase to have an essentially flat shape as that shown in FIG. 14.

Figure 15:
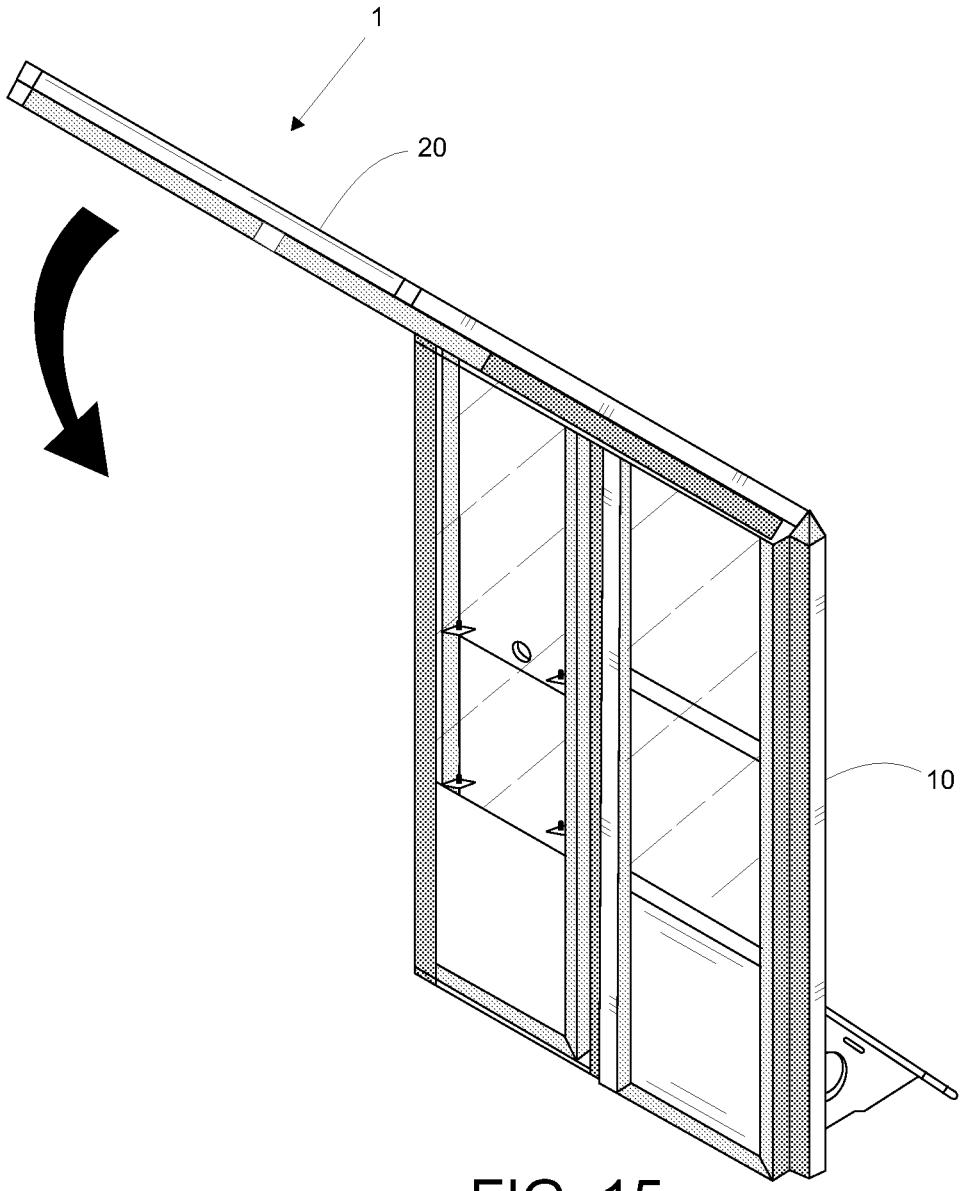
FIG. 15 is a right back perspective view of the collapsible showcase in FIG. 14 showing how to detach the upper panel from the lower panel.
Figure 16:
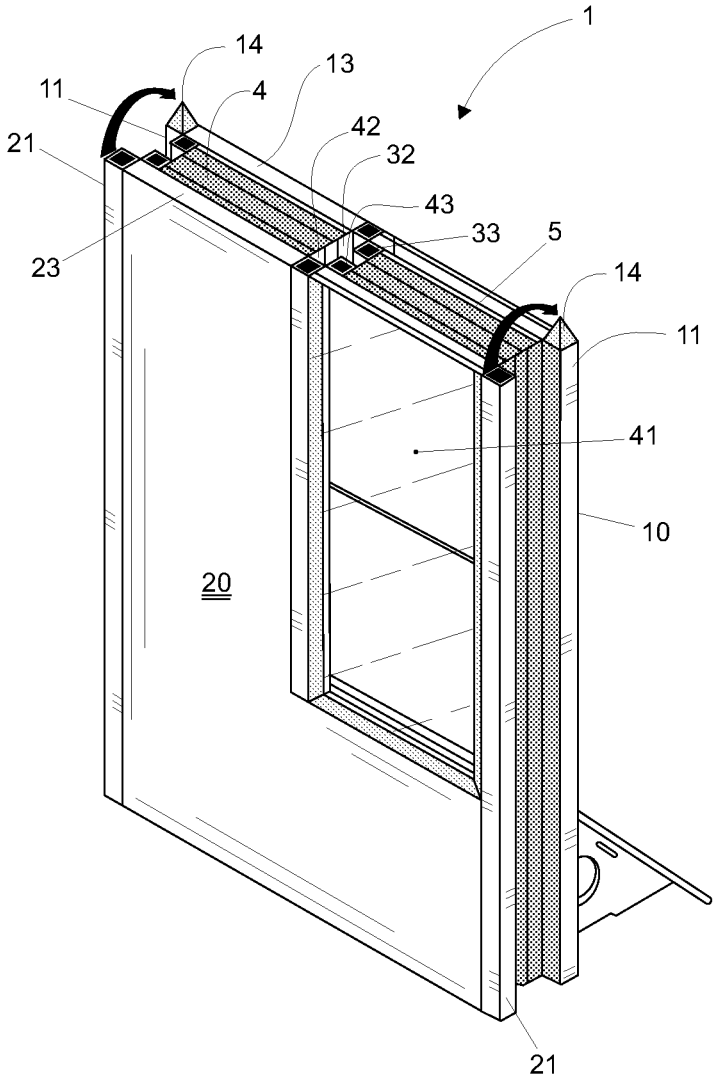
FIG. 16 is a right back perspective view of the collapsible showcase in FIG. 15, with the upper panel already detached and folded over the lower panel.

To continue describing how the showcase 1 is being folded, reference is made to FIGS. 15 and 16, in the former, the upper panel 20 is detached from the lower panel 10 and rotates downwards supported on the juncture where the upper compartment is hingedly attached to the lower compartment, that is, on hinges 4 and 5, which can be appreciated in FIG. 16 in such manner that at the end of this movement, both compartments already folded remain between both panels. In this sense, it has to be remembered that hinge 4 hingedly attaches the left side wall 42 of the upper panel to the left side wall 32 of the lower panel, the left side wall 42 of the upper panel being homologous to the left side wall 32 of the lower panel. Moreover, hinge 5 hingedly attaches the right side wall 43 of the upper compartment to the right side wall 43 of the upper compartment. When both compartments are at the upright position, hinges 4 and 5 are perpendicular to the showcase 1 (see FIG. 4), but when both compartments are folded, said hinges 4 and 5 are parallel thereof and aligned one next to the other. Due to this arrangement, the upper panel 20 at being detached may be easily rotated at the lower panel direction 10 leaving the compartments folded between both panels in a sandwiched manner, such as shown in FIG. 16, wherein in both folded compartments, only the left side walls 32 and 42 as well as the right side walls 33 and 43 can be appreciated.

In FIG. 16 it may be seen that a mounting portion 14 is provided at the upper end of each side post 11 of the lower panel 10 and introduced in the side posts 21 of the upper panel 20, wherein the mounting portion 14 is mounted on the lower panel 10, moreover, the bend 13 of the lower panel 10 and the rim bending 23 of the upper panel 20, may be seen, as explained, at the upright position of the showcase, the rim bending 23 of the upper panel 20 is seated on the rim bending 13 of the lower panel. Finally, in FIG. 16 the front wall 41 may be seen, which as mentioned, is built in the upper panel.

Figure 18:
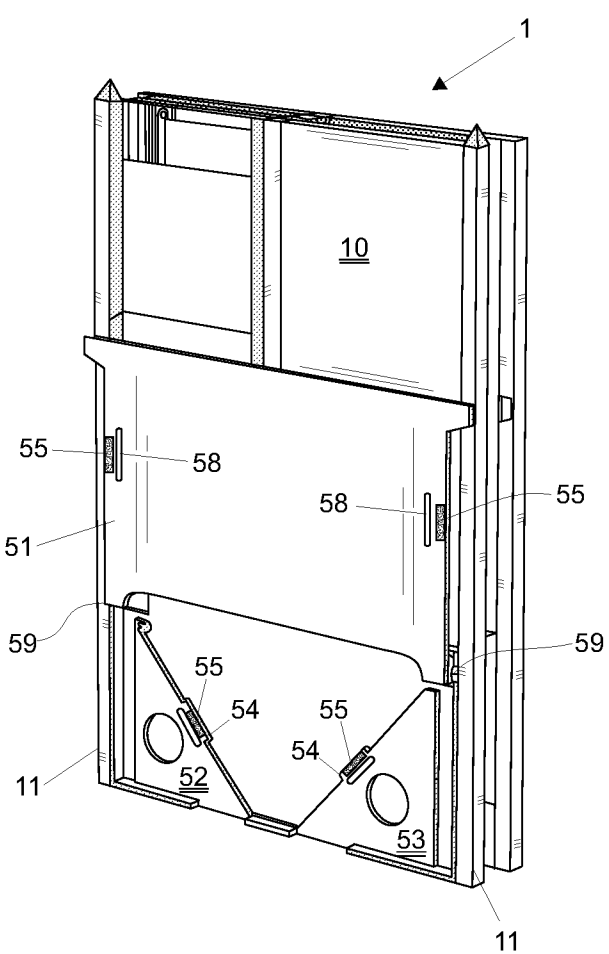
FIG. 18 shows the collapsible showcase of FIG. 17 after the base has been folded.
Figure 17:
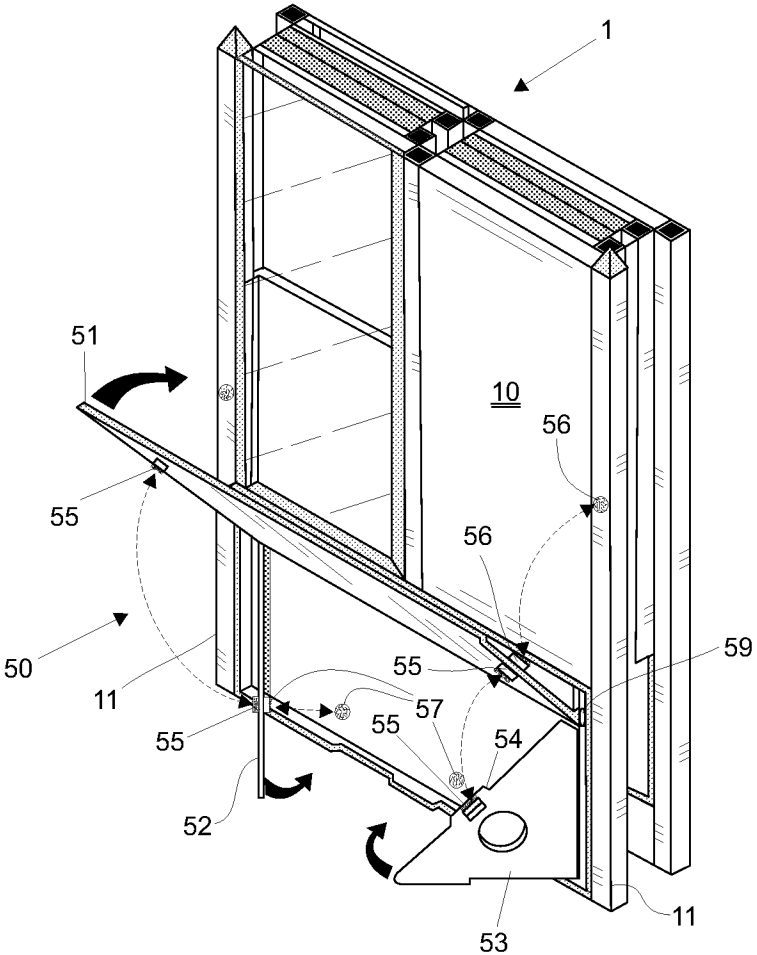
FIG. 17 is a right front perspective view showing how to fold the showcase base.

Now, reference will be made to FIGS. 17 and 18, to describe how the collapsible base 50 is conformed and how it folds. As already mentioned above, base 50 serves to stabilize the showcase 1, and in the embodiment being described, is formed by a plate 51 hingedly attached to the front face of the lower panel 10 by axles 59. When base 50 is at the upright position, the plate 51 runs from its juncture point at the lower panel 10 to the floor, the base also includes a pair of lower fins 52 and 53 hingedly attached to the lower panel 10 and near its side posts 11. The lower fins 52 and 53 protrudes outwards from said lower panel 10 and have a right triangle shape, wherein its larger flank is contacting with the plate lower face 51 and its base is located contacting the floor; both lower fins 52 and 53 includes a tab 54 being inserted in the cooperative slots 58 provided in the plate 51. The lower fins 52 and 53 in the plate 51 are kept fixed to each other by hook and fiber (Velcro®) cooperative portions 55, 57 provided both at the fins 52 and 53 as well as at the plate lower face 51.

In order to fold the base 50, the hook and fiber (Velcro®) portions are disengaged and the tabs 54 are removed from the slot 58, then the plate rotates upwards to remain in contact with the lower panel 10, and it is kept fixed thereto by hook and fiber (Velcro®) portions 56 preferably provided in the side posts 11 of the lower panel 10 and over the lower plate 51. Further, fins 52 and 53 rotate towards one another to be left over and contacting the lower panel 10, said fins also include hook and fiber (Velcro®) cooperative portions to keep them fixed to the lower panel, finally achieving the end of the showcase folding 1.

Figure 20:
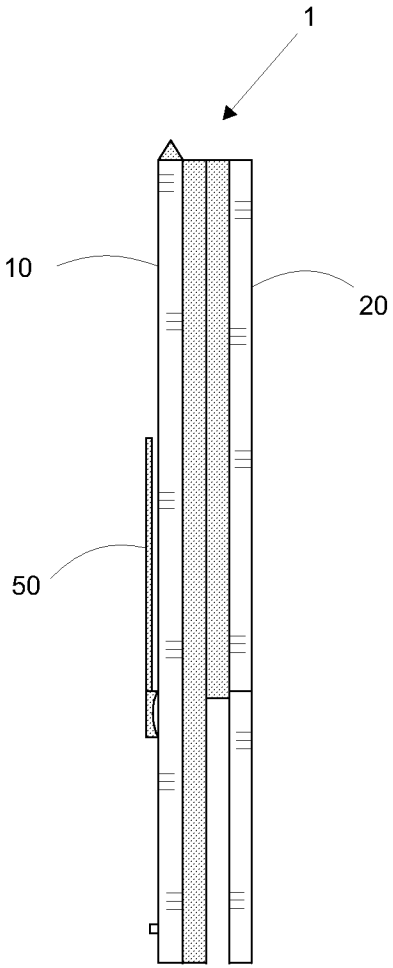
FIG. 20 is a right side view of the showcase of FIG. 19 in the folded position.
Figure 19:
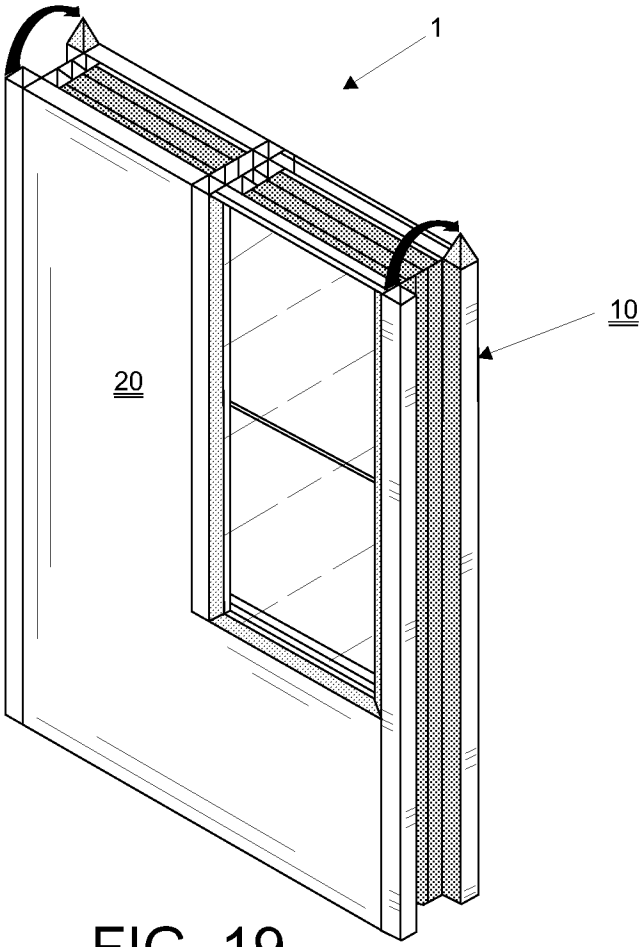
FIG. 19 is a right back perspective view of the collapsible showcase of FIG. 18 in its folded position.

FIGS. 19 and 20 are a back view of the showcase 1 in the folded position, essentially flat, respectively, since the base 50 is folded together with the lower panel 10, and the compartments are folded between both upper and lower panels. The showcase 1 being folded in this manner, may be placed inside a case for protection and transportation from a place to another.

The collapsible showcase of the present invention, in any embodiment thereof, is highly resistant and is manufactured preferably form polymeric materials such as PVC, acrylic or carbonate. More specifically, the panel posts are made with extruded PVC hollow profiles. The panels, the collapsible inner shelves and the compartments upper and lower walls are made with foamed PVC plates, while the wall transparent portions are made of acrylic sheets. Hinges 2 to 9 and 16 are plastic hinges adhered to the showcase corresponding parts without having to made any kind of boring as will be required if metal hinges be used, however, there is no restriction to use any kind of hinges. Metal parts are few excepting for the locks 6.

In a very specific embodiment, and without limiting the present invention, it may be noted that the upper compartment inner volume is of about 0.056 $m^3$ while the lower is of 0.084 $m^3$. The showcase has a height of 172 cm, a length of 62 cm, and a width including the base and the components being straight, of 58 cm. While in the folded position of the showcase, the height of the shelf half decreases, that is, 86 cm, the length 62 cm is maintained, while its width, being the most important dimension, is only of about 11 cm. allowing the showcase to be transported and stored without taking up a lot of room.

As can be seen, the structural relationship among the collapsible showcase members allows having a great volume, and due to the inner shelves, it has a great versatility to organize the compartments. In addition, said structural relationship allows the folding of the showcase in a very compact manner. However, when in the upright position, it is very resistant and stable, in such manner that it can be used in infinity of applications, being its main use in sites known as points of sale.

Although one preferred embodiment of the present invention has been described and exemplified, it should be stressed that numerous modifications thereto cane be made, such as to the type of hinges employed, compartments location or the inner shelves number, etc. Therefore, the present invention shall not be deemed as limited except for the teachings of the prior art and by the scope of the appended claims.

The invention claimed is:

1. A collapsible showcase comprising:

i) a lower panel having two side posts and an intermediate post located between the two side posts;

ii) an upper panel hingedly attached on top of the lower panel and having two side posts and an intermediate post located between the two side posts;

iii) a lower collapsible compartment attached to the lower panel and protruding outwards thereof, the lower collapsible compartment disposed between a first one of the two side posts and the intermediate post of the lower panel;

iv) an upper collapsible compartment attached to the upper panel and protruding outwards thereof, the upper collapsible compartment disposed between a first one of the two side posts and the intermediate post of the upper panel;

wherein the lower and upper compartments each have a front wall built in the lower and upper panel, respectively, where the lower and upper compartments are attached to the respective lower and upper panels;

a left side wall hingedly attached to the front wall;

a right side wall hingedly attached to the front wall;

a rear door hingedly attached to one of the side walls and housed therein;

a top hingedly attached to one of the side walls and housed therein; the top being detachably joined to a side wall opposite to the one of the side walls to which the top is hingedly attached; and, a bottom hingedly attached to one side of the side walls and housed therein, the bottom being detachably joined to a side wall opposite to the one of the side walls to which the top is hingedly attached; and wherein, the upper compartment is located immediately over the lower compartment and the upper and lower compartments are hingedly attached to the upper and lower panels respectively, in at least one of the left and right side walls of the upper and lower compartments;

v) a collapsible shelf attached to the upper or lower panel and housed therein when the showcase is folded, the collapsible shelf located between a second one of the of the two side posts and the intermediate post of the upper panel or between a second one of the of the two side posts and the intermediate post of the lower panel; and vi) a collapsible base attached to the lower panel and protruding from the lower panel in a direction opposite from the compartments to provide stability to the showcase;

wherein, in a state in which the showcase is collapsed from an upright position into a folded position, the top and bottom of the upper and lower compartments are detached and housed within the side wall to which the upper and lower compartments are hingedly attached; the rear door of each compartment is housed within the side wall to which the compartment rear door is attached; the left and right side walls are moved next to the upper and lower panel to which the upper and lower compartments are attached, the side walls are stored one aside another, thereby to permit finishing the folding of the upper and lower compartments; the upper panel is detached from the lower panel and rotated downwards supported at an area of a juncture between the upper and lower compartments where the upper and lower compartments are hingedly attached to one another in such manner that at the end of the movement the folded upper and lower compartments are located between the upper and lower panels; and the base is folded and stored next to the lower panel, thereby achieving the folded position of the showcase.

2. A collapsible showcase according to claim 1, wherein the lower or upper compartments include at least one divider to form sub-compartments.

3. A collapsible showcase according to claim 2, wherein said divider is a collapsible inner shelf hingedly attached to one of the side walls of the compartment in which the collapsible inner shelf is positioned; the inner shelf being housed in the side wall to which the inner shelf is hingedly attached and the inner shelf is detachably joined to a side wall opposite to the side wall to which the inner shelf is hingedly attached at the upright position of the showcase.

4. A collapsible showcase according to claim 3, wherein the collapsible inner shelf is housed in a vertical position with respect to the side wall to which the inner shelf is attached and is fixed in said vertical position by a first fastening means.

5. A collapsible showcase according to claim 4, wherein said first fastening means are hook and fiber cooperative portions adhered to an upper or lower face of the collapsible inner shelf and to an inner face of the side wall on which said plate is hingedly attached.

6. A collapsible showcase according to claim 2, further comprising a collapsible inner shelf provided in the upper compartment in order to form two sub-compartments.

7. A collapsible showcase according to claim 2, further comprising two collapsible inner shelves provided at the lower compartment in order to form three sub-compartments.

8. A collapsible showcase according to claim 1, wherein the bottom of the upper compartment is at the same time the top of the lower compartment such that the upper and lower compartments share a common wall.

9. A collapsible showcase according to claim 1, wherein the upper or lower compartments extend rearwards of the upper or lower panel to which the upper or lower compartments, respectively, are attached.

10. A collapsible showcase according to claim 1, wherein each lower panel and upper panel comprise a plate including a rim bending protruding rearwards of the showcase on an opposite side of the panel than said upper and lower compartments, respectively; the plate being joined by said rim bending between the side posts, wherein a mounting projection is disposed at the upper end of each side post of the lower and upper panel, said mounting projection being on the upper end of the side post of the lower panel is inserted in the side posts of the upper panel.

11. A collapsible showcase according to claim 10, wherein the upper panel rim bending sits on the lower panel rim bending at a middle zone of the showcase to provide stability to the upper panel and to avoid pivoting on the lower panel.

12. A collapsible showcase according to claim 1, wherein the rear door of at least one of the upper or lower compartment includes locking means to lock the door and to restrict access to the at least one of the upper or lower compartment.

13. A collapsible showcase according to claim 12, wherein said locking means are padlocks, latches or pins.

14. A collapsible showcase according to claim 1, wherein, in each compartment, at least one of the side walls, the front wall or rear door is transparent.

15. A collapsible showcase according to claim 1, wherein said collapsible shelf comprises: a cover hingedly attached to the lower panel in such manner that the collapsible shelf may be housed therein; a pair of side fins contacting a lower face of the cover at an upright position of the showcase, both side fins are hingedly attached to the lower panel and may be housed one above with respect to another in said lower panel and below the cover; and, a lower fin hingedly attached to a lower face of the cover; the lower fin having a pair of tabs disposed at a flank portion configured to be inserted into cooperative slots provided at the side fins.

16. A collapsible showcase according to claim 1, wherein both upper and lower compartments are hingedly attached by a pair of hinges, one of said hinges attaches the right side walls of the upper and lower compartments and another one of said hinges attaches the left side walls, both hinges are perpendicular to the showcase when the showcase is at the upright position and are aligned one next to another in a parallel way to the showcase when the showcase is folded.

17. A collapsible showcase according to claim 1, wherein said base comprises: a plate hingedly attached to a front face of the lower panel, said plate, in an upright position of the showcase runs slanted from a juncture point of the lower panel and a floor; a pair of lower fins hingedly attached to the lower panel, which protrude outwards from said lower panel and have a right triangular shape, wherein a longest flank of the pair of lower fins contacts a lower face of the plate and a base of the pair of lower fins contacts the floor, each fin of said pair of fins including a tab configured to be inserted into a cooperative slot provided at the plate; wherein to fold the base, the plate rotates upwards to be in contact with the lower panel, and the fins rotate one towards the other to be in contact with the lower panel.

18. A collapsible showcase according to claim 17, wherein at an upright position of the showcase, said lower fins and the plate are fixed to each other.

19. A collapsible showcase according to claim 17, wherein at the folded position of the showcase, the plate is fixed to the lower panel.

20. A collapsible showcase according to claim 17, wherein at the folded position of the showcase, the fins are fixed to the lower panel.

* * * * *